US006710557B1

(12) United States Patent
Allen et al.

(10) Patent No.: US 6,710,557 B1
(45) Date of Patent: Mar. 23, 2004

(54) LINEAR ACCELERATOR

(75) Inventors: John Allen, Haywards Heath (GB); Leonard Knowles Brundle, Haywards Heath (GB); Terry Arthur Large, Lindfield (GB); Terence Bates, Horsham (GB)

(73) Assignee: Elekta AB, Stockholm (SE)

( * ) Notice: Subject to any disclaimer, the term of this patent is extended or adjusted under 35 U.S.C. 154(b) by 42 days.

(21) Appl. No.: 10/049,352

(22) PCT Filed: Aug. 3, 2000

(86) PCT No.: PCT/GB00/03004

§ 371 (c)(1),
(2), (4) Date: Feb. 5, 2002

(87) PCT Pub. No.: WO01/11928

PCT Pub. Date: Feb. 15, 2001

(30) Foreign Application Priority Data

Aug. 10, 1999 (GB) ..... 9918787

(51) Int. Cl.[7] ..... H01J 25/10

(52) U.S. Cl. ..... 315/505; 315/5.42; 250/492.1

(58) Field of Search ..... 250/505.1, 492.1; 315/505

(56) References Cited

U.S. PATENT DOCUMENTS 4,286,192 A * 8/1981 Tanabe et al. ..... 315/5.41
4,382,208 A * 5/1983 Meddaugh et al. ..... 315/5.41
4,629,938 A * 12/1986 Whitham ..... 315/5.41
4,746,839 A * 5/1988 Kazusa et al. ..... 315/5.41

FOREIGN PATENT DOCUMENTS

GB 2 334 139 8/1999

OTHER PUBLICATIONS

Eiji Tanabe and Robery W. Hamm "Compact Multi–energy Electron linear Accellerators", Nuclaer Instruments and Methods in Physics Research B10/11 (1985) 871–876, North Holland, Amsterdam.*

Tanabe E. et al: "Compact multi–energy electron linear accelerators" Nuclear Instrumnets & Methods in Physics Research, Section—B: Beam Interactions with Materials and Atoms, NL, North–Holland Publishing Company. Amsterdam, vol. B10/11, No. Part 02, 1985, pp. 871–876, p. 873, right–hand column, paragraph 2.

Jaffray d. A. et al: "dual–beam imaging for online verification of radiotherapy field placement" Workshop on the Implementatiuon of Three Dimensional conformal Radiotherapy, Bethesda, MD, USA, Apr. 21–22 194, vol. 33, No. 5, pp. 1273–180, International Journal of Radiation Oncology Biology Physics, Dec. 1, 1995, Elsevier, UK.

* cited by examiner

*Primary Examiner*—John R. Lee
*Assistant Examiner*—James J. Leybourne
(74) *Attorney, Agent, or Firm*—Kinney & Lange, P.A.

(57) ABSTRACT

An accelerator comprises a plurality of accelerating cells arranged to convey a beam, adjacent cells being linked by a coupling cell, the coupling cells being arranged to dictate the ratio of electric field in the respective adjacent accelerating cells, at least one coupling cell being switchable between a positive ratio and a negative ratio. Such an accelerator in effect inserts a phase change into the E field by imposing a negative ratio, meaning that the beam will meet a reversed electric field in subsequent cells and will in fact be decelerated. As a result, the beam can be developed and bunched in early cells while accelerating to and/or at relativistic energies, and then bled of energy in later cells to bring the beam energy down to (say) between 100 and 300 KeV. Energies of this magnitude are comparable to diagnostic X-rays, where much higher contrast of bony structures exists. Hence the accelerator can be used to take kilovoltage portal images.

9 Claims, 4 Drawing Sheets

LINEAR ACCELERATOR

FIELD OF THE INVENTION

The present relates to a linear accelerator.

BACKGROUND ART

In the use of radiotherapy to treat cancer and other ailments, a powerful beam of the appropriate radiation is directed at the area of the patient which is affected. This beam is apt to kill living cells in its path, hence its use against cancerous cells, and therefore it is highly desirable to ensure that the beam is correctly aimed. Failure to do so may result in the unnecessary destruction of healthy cells of the patient. Several methods are used to check this, and an important check is the use of a so-called "portal image". This is an image produced by placing a photographic plate or electronic imaging plate beneath the patient during a brief period of Irradiation. The beam is attenuated by the patient's internal organs and structures, leaving an image in the plate. This can then be checked either before complete treatment or after a dose, to ensure that the aim was correct.

Portal images are however extremely difficult to interpret. The energy of the beam which is necessary to have a useful therapeutic effect is very much greater than that used for medical imaging. At these higher energies there is smaller ratio in the relative attenuation between bony and tissue structure, which results in portal images with poor contrast. Structures within the patient are difficult to discern.

Some existing radiotherapy devices include a second radiation source which is adapted to produce a lower energy beam for producing a portal image. This second source is usually placed either alongside the principal accelerator and parallel thereto, or is mounted at an angle such that the entire unit is rotated about the patient to bring the second source into line for the portal image, following which the unit is rotated back for treatment. Both arrangements present difficulties in ensuring adequate alignment between the principal accelerator and the second source.

It has not hitherto been possible simply to reduce the energy of the principal (therapeutic) accelerator, since this must operate in a relativistic mode in order to maintain beam quality. If the final beam energy is too low, then the beam will be non-relativistic at earlier parts of the accelerator, preventing satisfactory operation.

SUMMARY OF THE INVENTION

The present invention therefore provides an accelerator comprising a plurality of accelerating cells arranged to convey a beam, adjacent cells being linked by a coupling cell, the coupling cells being arranged to dictate the ratio of electric field in the respective adjacent accelerating cells, at least one coupling cell being switchable between a positive ratio and a negative ratio.

Such an accelerator is eminently suitable for therapeutic use as part of a radiotherapy apparatus as a phase change is in effect inserted into the E field by imposing a negative ratio meaning that the beam will meet a reversed electric field in subsequent cells and will in fact be decelerated. As a result, the beam can be developed and bunched in early cells while accelerating to and/or at relativistic energies, and then bled of energy in later cells to bring the beam energy down to (say) between 100 and 300 KeV. Despite this low output energy, the beam is relativistic over substantially the same length of the accelerator, as previously. Energies of this magnitude are comparable to diagnostic X-rays, where much higher contrast of bony structures exists. Hence the accelerator can be used to take kilovoltage portal images.

It is preferred that the switchable coupling cell comprises a cavity containing a conductive element rotatable about an axis transverse to the beam axis. This is more preferably as set out in our earlier application PCT/GB99/00187, to which specific reference is made and the contents of which are hereby incorporated by reference. Protection may be sought for features set out in this application in combination with features set out in that application.

The application likewise relates to the use of an accelerator in which a plurality of accelerating cells arranged to convey a beam, and adjacent cells are linked by a coupling cell, the coupling cells being arranged to dictate the ratio of electric field in the respective adjacent accelerating cells, wherein at least one coupling cell is switched between a positive ratio and a negative ratio.

Further, the application relates to an operating method for an accelerator in which a plurality of accelerating cells arranged to convey a beam, and adjacent cells are linked by a coupling cell, the coupling cells being arranged to dictate the ratio of electric field in the respective adjacent accelerating cells, wherein at least one coupling cell is switched between a positive ratio and a negative ratio.

BRIEF DESCRIPTION OF THE DRAWINGS

An embodiment of the invention will now be described by way of example, with reference to the accompanying figures, in which.

DETAILED DESCRIPTION OF THE EMBODIMENTS

Figure 1:
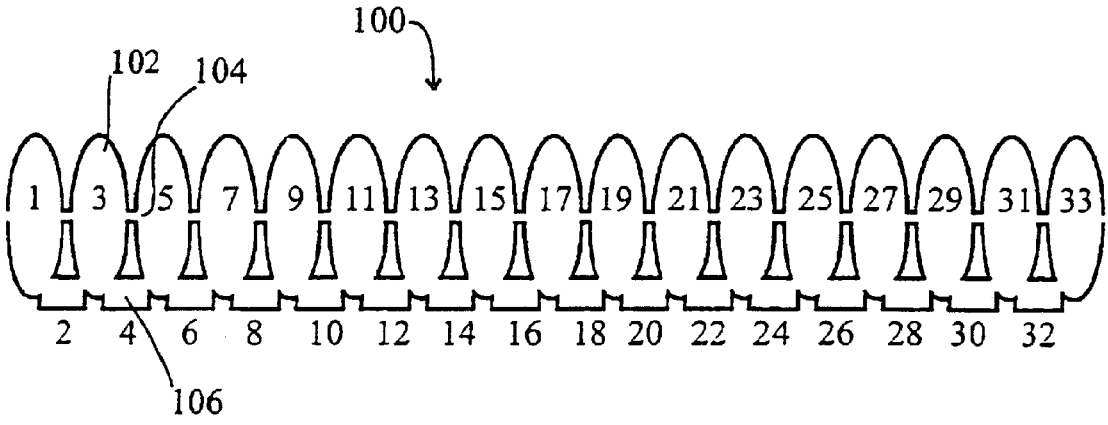
FIG. 1 is a schematic illustration of a conventional linear accelerator.

Referring to FIG. 1, a conventional accelerator 100 has a series of accelerating cells such as 102. These are arranged in a linear array and communicate via an aperture 104 on the centerline of each. An accelerating beam of electrons passes along that path through each accelerating cell. Coupling cells such as 106 are arranged between adjacent accelerating cells and provide a degree of rf coupling between accelerating cells. This coupling regulates an rf standing wave which is established in the accelerator by an external means (not shown).

Conventionally, the cells are numbered starting at the first accelerating cell and sequentially for each cell of whatever type. Thus the first coupling cell, between the first and second accelerating cells, is cell 2. The second accelerating cell is then cell 3. This is illustrated in FIG. 1, and results in accelerating cells being odd-numbered and coupling cells being even-numbered.

Figure 2:
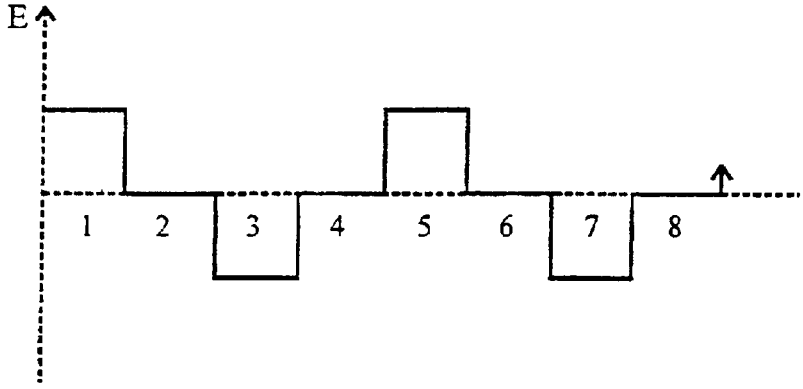
FIG. 2 shows a desirable electric field in the accelerator of FIG. 1.

FIG. 2 shows the desired rf pattern in the cells. It should be remembered that the pattern is that of a standing wave illustrated at an instant in time, so the actual E field at a particular location oscillates between the maximum shown in FIG. 2 and the reverse field. The field is ideally positive in cell 1, zero in cell 2, negative in cell 3, and zero in cell 4. It then repeats this pattern of being zero in the coupling cells and alternating polarity in successive accelerating cells. The accelerator is sized in relation to the frequency of the rf standing wave such that in the time that the accelerating electron moves from one cell to another, for example from cell 23 to cell 25, the standing wave will have completed one half cycle. As a result, the E field in cell 25 will, when the electron arrives, be the opposite of its value when the electron was in cell 23. Thus, the E field will be positive, so far as the electron observes, in every accelerating cell and the electron will steadily gain energy from the E field as it progresses.

In the later accelerating cells, the energy of the electron is such as to render its movement relativistic. As it gains energy, therefore, its speed remains substantially constant despite its rising kinetic energy. This allows the phase relationship between the rf standing wave and the progressing electron to remain fixed. It is therefore important that the beam remains relativistic, since it will otherwise fall out of synchronisation with the rf standing wave. It is not therefore possible to reduce the output energy of the beam by reducing the acceleration lie the rf power) since although the beam would in theory be relativistic when output, it would have been non-relativistic for a substantial length of the accelerator and the beam would therefore suffer loss of phase synchronism.

Figure 3:
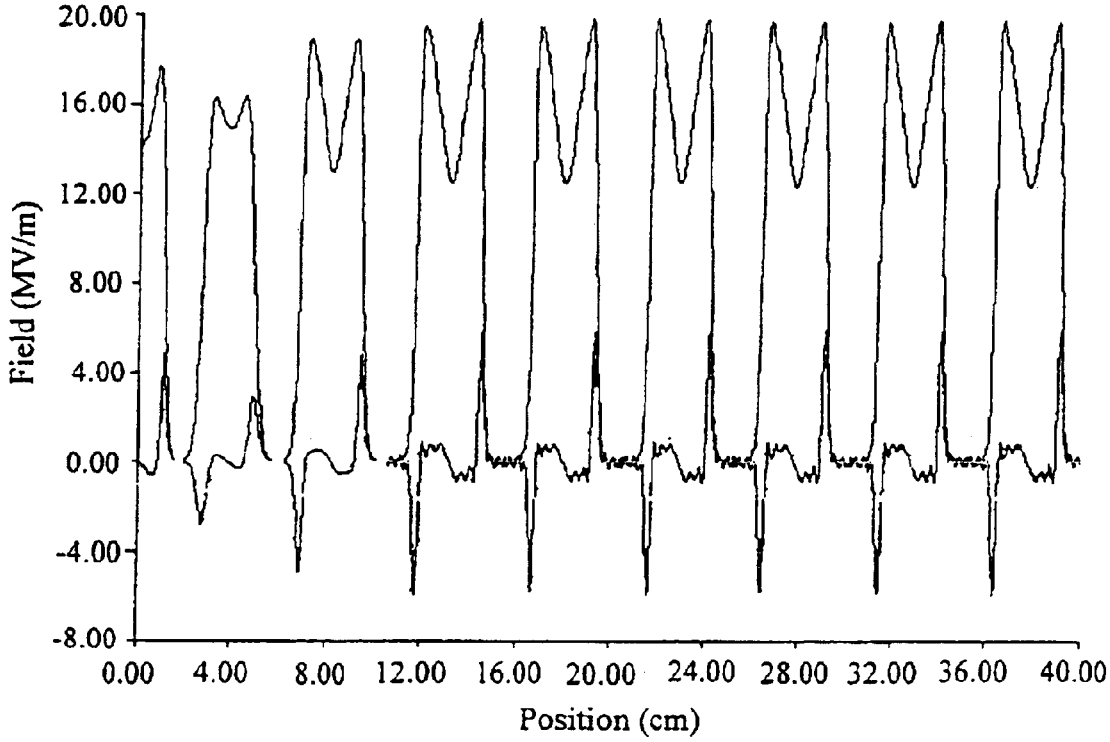
FIG. 3 shows a typical electric field as "observed" by an electron being accelerated.

FIG. 3 shows a plot of the likely actual E field as observed by the electron during its passage through the accelerator. It can be seen that there are a number of points corresponding to the centres of accelerating cavities where the E field is strong and positive. Between these areas the field is small and can be ignored. Within cells, the field approximates to that desired.

Figure 4:
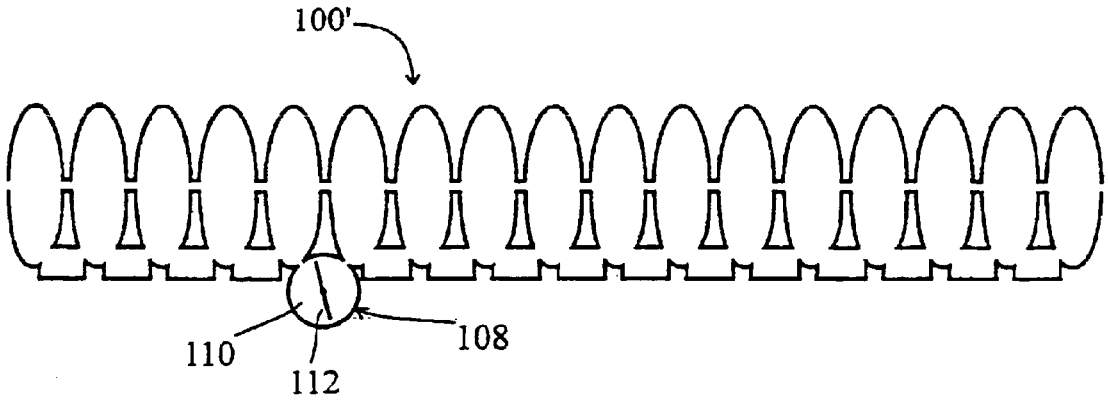
FIG. 4 shows a linear accelerator according to the present invention.
Figure 5:
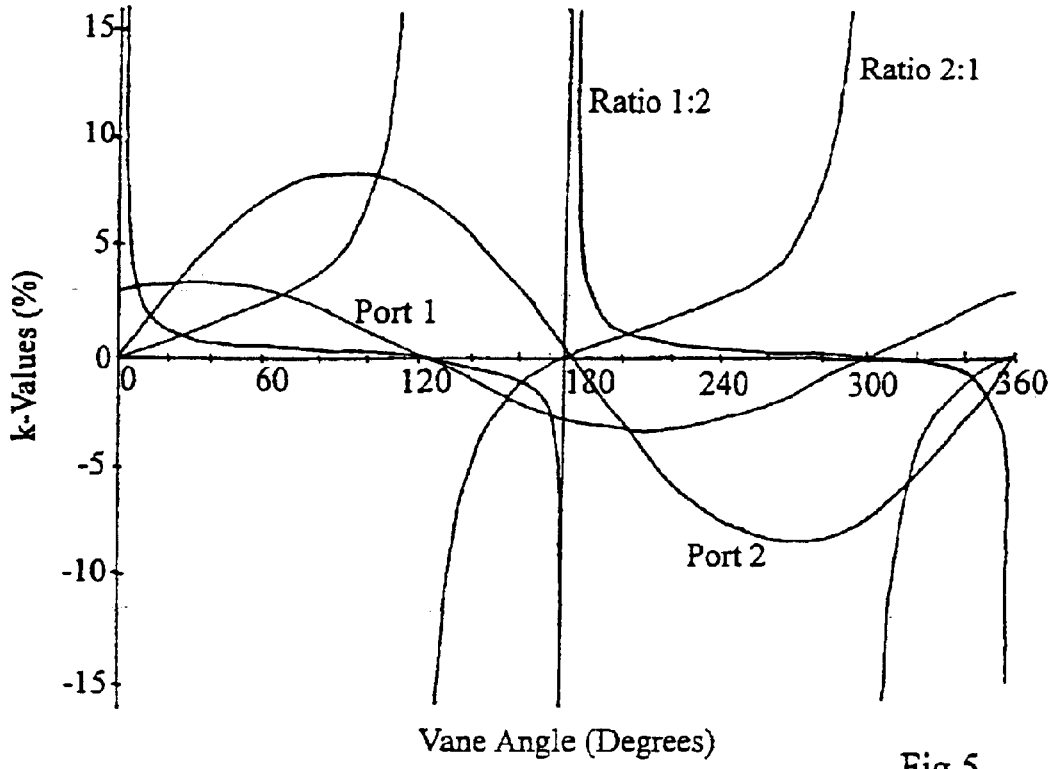
FIG. 5 shows the variations of the individual coupling coefficients between cell 108 of FIG. 4 and the two adjacent coupling cells, and shows the variation of the ration of these coefficients as the conductive element (the vane) is rotated.

FIG. 4 shows a linear accelerator according to the present invention. Cell 10 is replaced with a variable coupling cell 108 which comprises a substantially cylindrical cavity 110 aligned transverse to the axis of the accelerator in which is placed a rotatable vane 112. This is as described in our earlier application PCT/GB99/00187, to which the reader is referred. As described In that application, this arrangement allows a wide range of ratios of coupling coefficients to be obtained. However, it is now further apparent that this arrangement can in fact generate a negative ratio, as shown in FIG. 5. This shows the coupling coefficients and the ratio between them as the vane is rotated through 360°. It will be seen in this figure that over some ranges of vane angle, both coupling coefficients have the same sign and hence the ratio between them is positive, but that over other ranges of vane angle the coupling coefficients have different signs and hence the ratio in negative.

It is this ability of the arrangement to produce coupling coefficients that can either be of the same sign or be of opposite signs that can permit two portions of a linear accelerator either to both provide acceleration of particles or for one portion to accelerate whilst simultaneously for the other to decelerate.

In some regions, the ratio is very large indeed and the accelerator may well be unstable in these regions. However, in other areas such as between 30° and 180° on the scale as illustrated, the ratio can be varied smoothly between a moderate positive value and a moderate negative value.

Figure 5A:
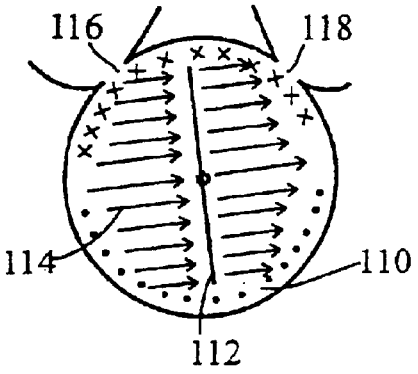
FIGS. 5*a* and 5*b* proposes an explanation of FIG. 5.
Figure 5B:
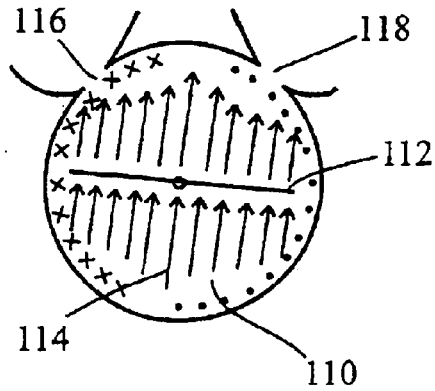

FIGS. 5*a* and 5*b* illustrate how this is believed to arise. Within the cavity, the orientation of the entire EM field pattern is dictated by the position of the vane 112, since (for instance) the E-field (114) lines must meet a conductive surface perpendicularly. However, RF coupling between the accelerating cells and coupling cell is predominantly magnetic with the axial H-field indicated by arrow ends (x and •) according to whether the field points into or out of the page).

Thus when the vane 112 is between ports 116, 118 (FIG. 5*a*) linking the accelerating and coupling cells, each port will see an H-field of the same polarity (e.g. both x ), giving rise to a positive coupling coefficient ratio and electron acceleration both upstream and downstream of the coupling cell. In general, these accelerating field strengths will differ according to the exact angular setting of the vane.

When the vane 112 is transverse to the ports 116, 118 (FIG. 5*b*), the polarity of the H-fields seen by the ports will be opposite (eg x and•) giving rise to a negative coupling coefficient ratio and thus electron acceleration upstream and deceleration downstream of the coupling cell.

Figure 6:
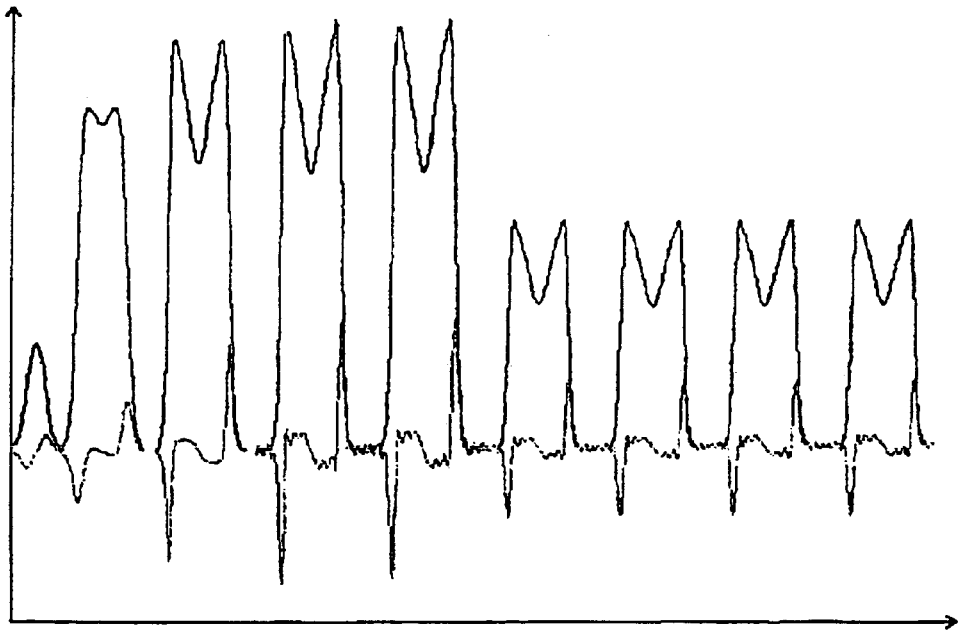
FIG. 6 shows an electric field seen by an electron for the accelerator of FIG. 4 with the rotatable element set to step down the E-field.
Figure 7:
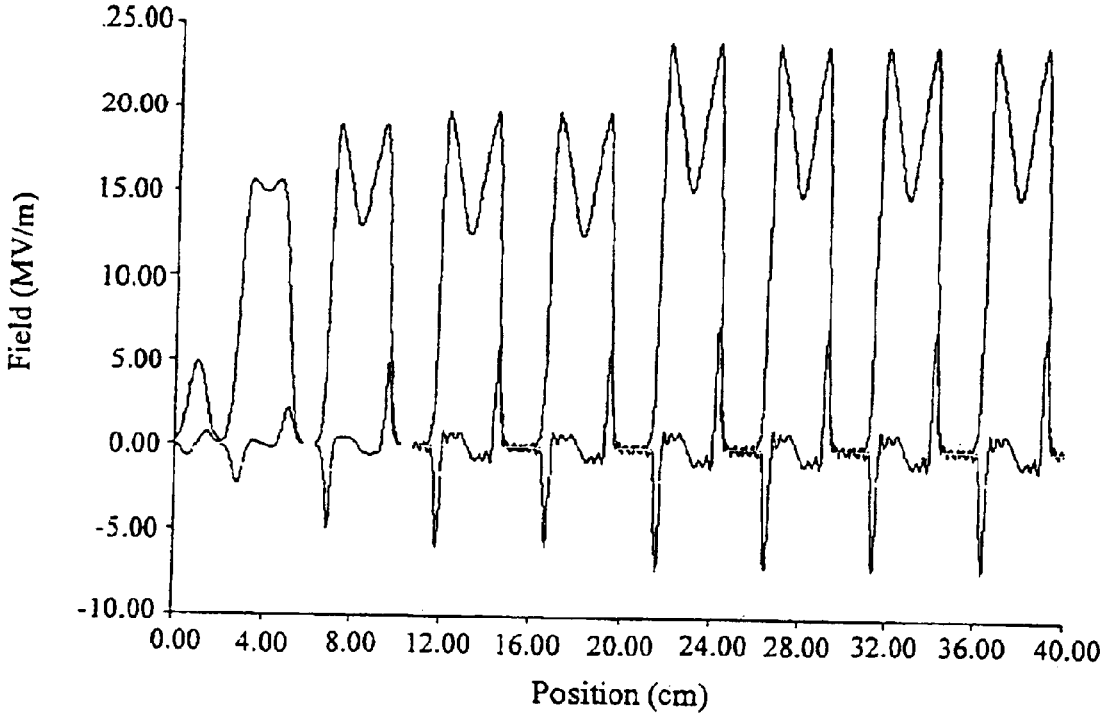
FIG. 7 shows a similar electric field with the rotatable element set to step up the E-field.
Figure 8:
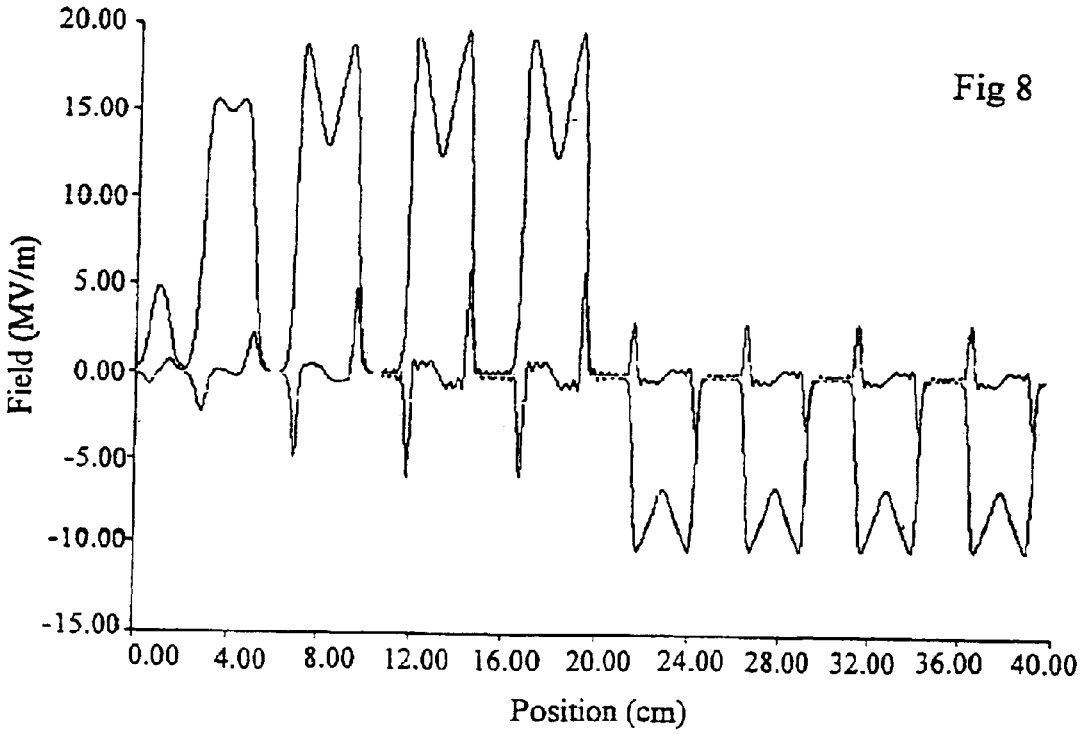
FIG. 8 shows a still further electric field with the rotatable element set to reverse the E-field.

FIGS. 6 and 7 show the effect on the accelerating cell E fields of a coupling coefficient ratio greater than unity and less than unity respectively. In FIG. 6, after cell 10, the electric field experienced by the accelerating beam drops, and the beam will therefore gain less energy and the output energy will be less. In FIG. 7, after cell 10, the electric field experienced by the accelerating beam rises, and the beam will therefore gain more-energy and the output energy will be greater. This illustrates the ability of the apparatus of PCT/GB99/00187 to vary the output energy of the beam. FIG. 8 shows the effect of a negative coupling coefficient ratio. The E field from cell 9 to cell 11 is reversed, effectively a phase change in the rf standing wave. Thus, from cell 11 onwards, the beam experiences an E field which acts to decelerate it, ie it loses energy to the E field. Thus, the beam output can be of a very low energy indeed. This enables a portal image to be taken with adequate contrast.

Attempts have previously been made to insert a phase change in the rf field by separating it from the beam and inserting an additional half wavelength path, but this raises severe difficulties in reuniting the rf and the beam. This arrangement avoids this difficulty entirely.

It will of course be apparent to those skilled in the art that many variations could be made to the above arrangements without departing from the scope of the present invention.

What is claimed is:

1. An accelerator comprising a plurality of accelerating cells arranged to convey a beam, adjacent cells being linked by a coupling cell, the coupling cells being arranged to dictate the ratio of electric field in the respective adjacent accelerating cells, at least one coupling cell being variable to allow a range of ratios including positive values and negative values.

2. An accelerator according to claim 1 in which the at least one coupling cell is variable smoothly from a positive value to a negative value.

3. An accelerator according to claim 1, in which the beam is relativistic over substantially the length of the accelerator.

4. An accelerator according to claim 1, in which the variable coupling cell comprises a cavity containing a conductive element rotatable about an axis transverse to the beam axis.

5. A method for manufacturing an accelerator to convey a beam, the method comprising:

arranging a plurality of accelerating cells to convey a beam; and linking adjacent cells by a coupling cell, the coupling cells being arranged to dictate the ratio of electric field in the respective adjacent accelerating cells, at least one coupling cell being variable to allow a range of ratios including positive values and negative values.

6. The method according to claim 5 in which the at least one coupling cell is variable to allow a smooth change of ratios from a positive value to a negative value.

7. A method for operating an accelerator, comprising:

providing a plurality of accelerating cells are arranged to convey a beam, wherein adjacent cells are linked by a coupling cell, the coupling cells being arranged to dictate the ratio of electric field in the respective adjacent accelerating cells; and varying at least one coupling cell to allow a range of ratios including positive values and negative values.

8. The method of claim 7, further comprising:

varying the at least one coupling cell smoothly from a positive value to a negative value.

9. The method of claim 7, further comprising:

taking kilovoltage portal images with the conveyed beam.

* * * * *

UNITED STATES PATENT AND TRADEMARK OFFICE

CERTIFICATE OF CORRECTION

PATENT NO. : 6,710,557 B1
DATED : March 23, 2004
INVENTOR(S) : John Allen et al.

It is certified that error appears in the above-identified patent and that said Letters Patent is hereby corrected as shown below:

Title page,
Item [56], References Cited, OTHER PUBLICATIONS, "Jaffray D. et al.," reference, delete "Implementatiuon", insert -- Implementation --

Column 1,
Line 20, delete "Irradiation", insert -- irradiation --.

Column 3,
Line 33, delete "lie", insert -- (ie --
Line 51, delete "In", insert -- in --

Signed and Sealed this

Twenty-first Day of December, 2004

JON W. DUDAS
*Director of the United States Patent and Trademark Office*